United States Patent [19]

Smith

[11] Patent Number: 4,646,922

[45] Date of Patent: Mar. 3, 1987

[54] BEVERAGE DISPLAY STAND

[75] Inventor: Jerrold A. Smith, Plainview, N.Y.

[73] Assignee: Arrow Art Finishers Co., Bronx, N.Y.

[21] Appl. No.: 828,227

[22] Filed: Feb. 10, 1986

[51] Int. Cl.[4] ..... A47F 7/28

[52] U.S. Cl. ..... 211/186; 211/59.4; 211/132; 248/174; 248/150

[58] Field of Search ..... 211/59.4, 186, 132, 211/149, 150, 184, 135; 248/174

[56] References Cited

U.S. PATENT DOCUMENTS

| | | | |
|---|---|---|---|
| 2,775,352 | 12/1956 | Waite | 211/59.4 X |
| 2,908,395 | 10/1959 | Patterson | 211/59.4 |
| 3,151,744 | 10/1964 | Patterson | 211/59.4 |
| 3,677,203 | 7/1972 | Barrineau | 211/59.4 X |
| 4,322,005 | 3/1982 | Robertson | 211/59.4 |
| 4,506,790 | 3/1985 | Muscari | 211/59.4 |

*Primary Examiner*—Robert W. Gibson, Jr.

*Attorney, Agent, or Firm*—Kirschstein, Kirschstein, Ottinger & Israel

[57] ABSTRACT

A merchandise display stand has a plurality of shelves which are continuously adjustably movable to any desired elevation in corresponding display portions. The shelves, when not in use, are held in a common storage position at an upper region of the stand.

13 Claims, 5 Drawing Figures

BEVERAGE DISPLAY STAND

BACKGROUND OF THE INVENTION

1. Field of the Invention

The present invention generally relates to a beverage display stand and, more particularly, to a foldable, erectable, reusable display stand for supportably displaying beverages in cans, bottles or other containers on height-adjustable shelving.

2. Description of the Prior Art

There are already known various constructions of display stands for use, for example, in supermarkets or other retail establishments, for displaying articles or goods on sale. Such display stands are often used as more attractive alternatives to just merely stacking the articles atop one another, or displaying them in partially cut-off original cartons or boxes.

In the case of displaying beverages contained in cans, bottles or analogous containers, the weight of such articles can be rather substantial, and the display stand should be sturdy enough to be able to sustain and withstand their substantial weight, as well as rough handling on the part of supermarket personnel and shoppers.

It is already known in the art to display beverage containers on horizontal shelves mounted on display stands and positioned at predetermined fixed elevations relative to the floor. In loading a prior art display stand of this type, a first group of beverage containers is stacked on a base panel in contact with the floor. A first shelf is inserted into a first pre-formed slot formed in a back panel on the display stand, and this first shelf is brought to rest in a horizontal display position in which the first shelf is supported from below not only by the first slot, but predominantly by the first group of articles stacked on the base panel. A second group of beverage containers is next stacked above the first shelf. Thereupon, a second shelf is inserted into a second pre-formed slot on the back panel of the stand, and brought to rest in a horizontal display position in which the second shelf is supported from below not only by the second slot, but predominantly by the second group of articles stacked on the first shelf. Additional shelves are inserted into additional pre-formed slots provided at higher elevations compared to the first and second slots, and the loading of the display stand continues in the above-described manner in an upward direction until the last shelf and the last slot are reached.

To unload such prior art display stands, the beverage containers are typically removed by the shoppers from the topmost shelf and, when all the containers on the topmost shelf have been removed, the empty topmost shelf is moved from its generally horizontal article-supporting display position out of the way to a storage or non-use position so that the shopper can readily have access to the beverage containers provided on the next lower shelf. Each empty shelf, in its turn, is moved from its display position to a storage position, in accordance with the prior art, by either being pivoted upwardly about a rear edge of the shelf to a generally vertical position which is juxtaposed with the back panel, in accordance with one type of prior art embodiment, or, in accordance with another prior art embodiment, each empty shelf is inserted rearwardly further into its respective slot into the stand to a concealed or partly concealed position.

Although generally satisfactory for their intended purpose, the known prior art display stands have not proven to be altogether versatile in use. The provision of individual pre-formed slots at fixed locations on the stands prevent the shelves from being adjustably positioned at different elevations relative to the floor. Thus, each stand is essentially custom-made for a beverage container of a certain size; that is to say, soft drink cans of one height may be loaded on one particular stand, whereas one-half liter, one liter, or two liter soda bottles of different heights must be loaded on different stands which are specifically dimensioned and designed therefor. These custom-made stands are not altogether desirable because only the appropriately-sized display can be used for a particular beverage container. Hence, a store owner must stock and inventory many such stands if multiple beverage containers are to be on display.

It is also known in the art to form many different slots at different elevations on a particular large-sized display stand, and to provide instructions as to where an assembler must position each shelf to accommodate particular articles of known sizes. However, experience has shown that despite such instructions, such stands are often improperly assembled, leading to display instability. Eventually, such display stands are discarded rather than being properly disassembled and converted to display different articles. Also, if a display stand dimensioned for one particular-sized beverage container is on hand, and if the wrong sized articles are likewise on hand, experience has shown that store personnel, particularly inexperienced ones, will often load the wrong sized articles on the display stand, thereby leading to display instability and potential article breakage and spillage.

SUMMARY OF THE INVENTION

1. Objects of the Invention

It is a general object of this invention to overcome the aforementioned drawbacks of the prior art display stands.

It is another object of this invention to provide a single display on which articles of different heights may be loaded without causing display instability.

It is a further object of this invention to provide a display with shelves whose elevations are continuously adjustable to any desired height.

It is still another object of this invention to provide a display which is easy to erect, which is reusable, and which is easily convertible from one sized article to another.

It is yet another object of this invention to provide a sturdy, stable display having height-adjustable shelves which are versatile in use.

Another object of this invention is to provide a display stand which is constituted of corrugated board and which is, nevertheless, durable in construction and able to withstand and sustain the weight of substantially heavy articles such as beverage containers.

2. Features of the Invention

In keeping with these objects, and others which will become apparent hereinafter, one feature of this invention resides, briefly stated, in a stand for displaying articles which comprises a base on which articles are supportably stacked, an upright support extending upwardly from the base in a longitudinal direction, and a shelf mounted on the support for longitudinal movement between a storage position and a display position in which the shelf is supported from below by the articles stacked on the base and, in turn, supports additional articles stacked on the shelf.

In accordance with this invention, height-adjustment means are provided for continuously adjustably moving the shelf to any desired elevation above the base. Such height-adjustment means include a longitudinally-extending guide channel formed in, and longitudinally extending at least partially along, the upright support, as well as a guide member provided on the shelf and mounted in the guide channel for movement therealong to the desired elevation. Holding means are provided for holding the shelf in the storage position when the shelf is not in the display position.

In a preferred embodiment of this invention, the height-adjustment means includes an additional guide channel spaced transversely of the first-mentioned guide channel, and an additional guide member spaced transversely of the first mentioned guide member. Each of the guide channels advantageously has a narrow and a broader transverse section and, correspondingly, each guide member has a neck and a head portion receivable in the narrow and the broader transverse section, respectively, of each guide channel.

This invention also is embodied in providing at least one additional shelf mounted on the support for longitudinal movement between an additional storage position and an additional display position, in which the additional shelf is supported from below by the articles stacked on the first-mentioned shelf and, in turn, supports further articles stacked on the additional shelf. In this case, the height-adjustment means includes at least one additional guide member provided on the additional shelf, and mounted in the same guide channel for movement therealong to any desired elevation above the first-mentioned shelf. The aforementioned holding means in this case is further operative for holding the additional shelf in the additional storage position when the additional shelf is not in the additional display position.

Each shelf is generally planar, and lies in a horizontal plane in the display position. When not in use, each shelf is moved to the display position in which the shelf is tilted at an angle to the horizontal plane.

Advantageously, the holding means is located at an upper region of the upright support, and is operative for capturing the tilted shelf between itself and the upright support. In this connection, it is desirable to mount a header on the upper region of the upright support, and to form the holding means, preferably by die-cutting the header, as a resiliently-biased flap.

As described herein, articles of different heights may be loaded on a single display in view of the continuously-adjustable mounting of the shelves. The resulting display is very versatile in use, and can be used to hold many different types of articles, and particularly a broad range of beverage containers which come in many different sizes.

Yet another feature of this invention resides in constituting the display stand of corrugated board, cardboard or like materials, so that the upright support is constituted as a back panel having longitudinal edges, and side panels are hingedly connected at such longitudinal edges to the back panel. The base may preferably include a generally upright front panel having a front transverse edge to which a base panel is hingedly connected.

In order to provide for the quick erection of the display stand of this invention, it is further advantageous if a fold line or crease is provided transversely across the upright panel and the side panels. The stand is foldable about the fold line, and erectable from a collapsed condition in which the various panels are juxtaposed with one another, to an erect condition in which the side and base panels extend perpendicularly to the back panel, and in which the front panel extends parallel and at a spacing from the back panel.

To provide additional support to the base panel to sustain and withstand the heavy load of beverage containers, the display stand is further provided with a pair of support panels, each hingedly connected to one of the side panels and extending toward each other into the spacing between the front and back panels underneath the base panel as considered in the erect condition. Means are provided for urging the support panels toward one another to erect the stand with a snap-type action. Such urging means advantageously constitutes an endless elastically-yieldable element such as a rubber band which is mounted in slots formed on the support panels.

The novel features which are considered as characteristic of the invention are set forth in particular in the appended claims. The invention itself, however, both as to its construction and its method of operation, together with additional objects and advantages thereof, best will be understood from the following description of specific embodiments when read in connection with the accompanying drawings.

DETAILED DESCRIPTION OF THE PREFERRED EMBODIMENTS

Figure 1:
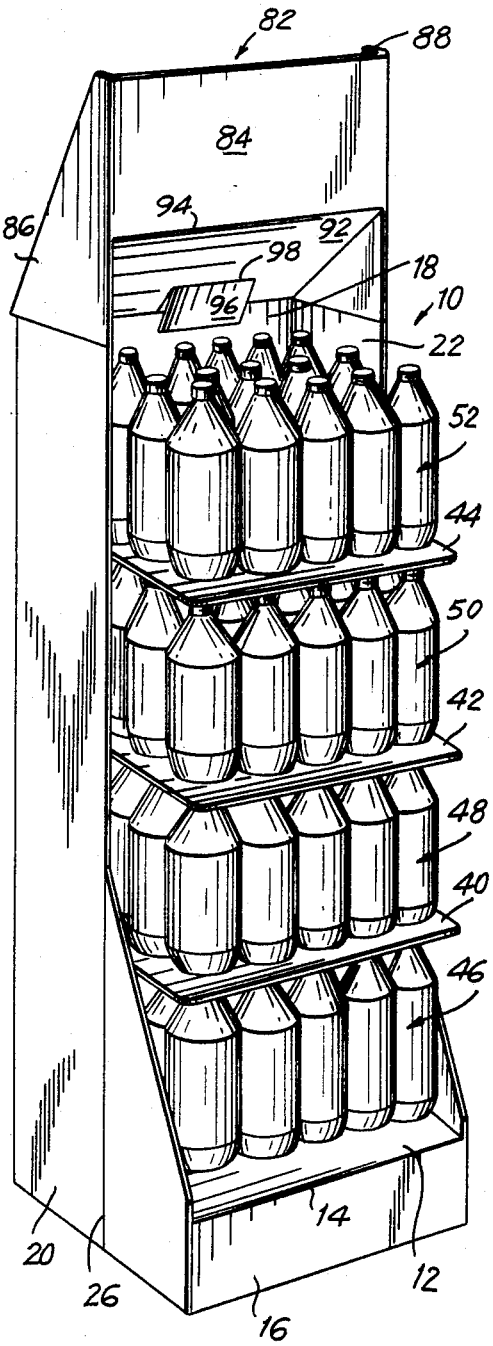
FIG. 1 is a front perspective view of an assembled display stand with shelves supported in a display position by beverage containers, in accordance with this invention.

Referring now to the drawings and, more particularly, to FIG. 1 thereof, reference numeral 10 generally identifies a merchandise display stand having shelves of the type which are, at least partially, if not predominantly, supported by the articles themselves to be displayed. The articles may be containerized or not and, if a product is containerized, the product may be any substance and may be received in virtually any container of rigid or semi-rigid material. As shown in FIG. 1, the product is a carbonated beverage which is filled in glass or plastic bottles. The following description in connection with a bottled beverage is presented for ease of description and illustration, and it will be readily understood by those skilled in the art that the article display stand of this invention is not intended to be limited to the display of carbonated soft drinks, although this is the preferred usage, but, instead, can apply to a multitude of articles to be displayed.

The stand 10 can be fabricated from any suitable material, preferably cardboard. The stand 10 is advantageously made from a single sheet of cardboard by forming appropriate fold and score lines in a single sheet blank, and by bending various portions or panels of the sheet blank into desired orientations relative to one another. The stand is erectable, as described below, from a collapsed condition in which the various panels are juxtaposed and lay substantially flat with one another, to an erect position, i.e. the position of use, which is depicted in FIG. 1. It should be understood that when reference is had in this description and in the claims to particular directions or dimensions, such designations are only valid with respect to the erect condition of the stand, and may or may not be valid with respect to the collapsed condition.

Hence, as shown in FIG. 1, the erected display stand 10 comprises a generally horizontal base panel 12 hingedly connected along a front transverse edge 14 to a generally vertical, short front panel 16. The base panel 10 is situated above the floor by the height of the front panel 16. The stand 10 also comprises an upright support including a generally vertical back panel 18 (see FIG. 2) spaced rearwardly at a spacing from, and extending generally parallel to, the front panel 16. The upright support also includes a pair of side panels 20, 22, each hingedly connected at lateral longitudinally-extending edges, e.g. edge 24 in FIG. 2, of the back panel 18. The side panels 20, 22 extend perpendicularly to, and interconnect, the back 18 and front 16 panels. Each side panel includes a pair of panel portions joined together at opposite sides of the stand at centrally located vertical joining lines 26.

As best shown in FIG. 6, a pair of support panels 28, 30, each comprised of two support panel portions 28*a*, 28*b* and 30*a*, 30*b*, respectively, are hingedly connected to a respective side panel portion at a lower region of the same. The support panel portions 28*a*, 28*b* and 30*a*, 30*b* extend toward each other into the space between the front 16 and back 18 panels underneath the base panel 12. Support panel portions 28*a*, 28*b* together form an elongated slot 32, and support panel portions 30*a*, 30*b* together form a similar elongated slot 34 which is parallel to slot 32. The slots 32, 34 extend substantially normally to the base panel 12. Each slot 32, 34 opens onto an upper edge of the support panel portions 28*a*, 28*b* and 30*a*, 30*b*.

Biasing means, preferably constituted of an endless elastically-yieldable element such as a rubber band 36, is provided on the support panels 28, 30. The band 36 has end portions mounted in the slots 32, 34 and, when so mounted, the band is slightly stretched and is under a slight tension so that the band will not fall out of the slots 32, 34 unless forcibly removed therefrom.

The stand 10 also has a fold line 38 extending transversely of the stand across the side and back panels thereof at an elevation approximately midway of the overall height of the stand, so that the upper half of the stand can be folded over and juxtaposed with the lower half of the stand for more compact storage. When so folded, the stand is in the aforementioned collapsed condition, and the side wall portions are, as shown in FIG. 6, extended outwardly, and the band end portions are similarly moved outwardly, thereby stretching the band. The stretched band, due to its elasticity, constantly seeks to restore itself to its initial position. The return of the band is prevented by reason of the folding over of the two halves of the support.

In order to erect the stand, it is merely necessary to unfold the stand by moving the upper half of the stand away from the lower half thereof and, once this unfolding has been started ever so slightly, the band 36 now takes over and releases its stored energy and deploys the stand to the erect condition with a snap-type action, so that the front and back panels will now be spaced parallel to, and offset from, each other, and the side panels will be perpendicular to the front and back panels. At the same time, the band 36 is operative to pull the support panels 28, 30 toward each other underneath the base panel so that the latter may rest on the upper edges of the support panel portions 28*a*, 28*b* and 30*a*, 30*b* to reinforce the base panel and assist it in sustaining and withstanding the weight of the bottled beverages to be loaded on the display stand 10.

Figure 3:
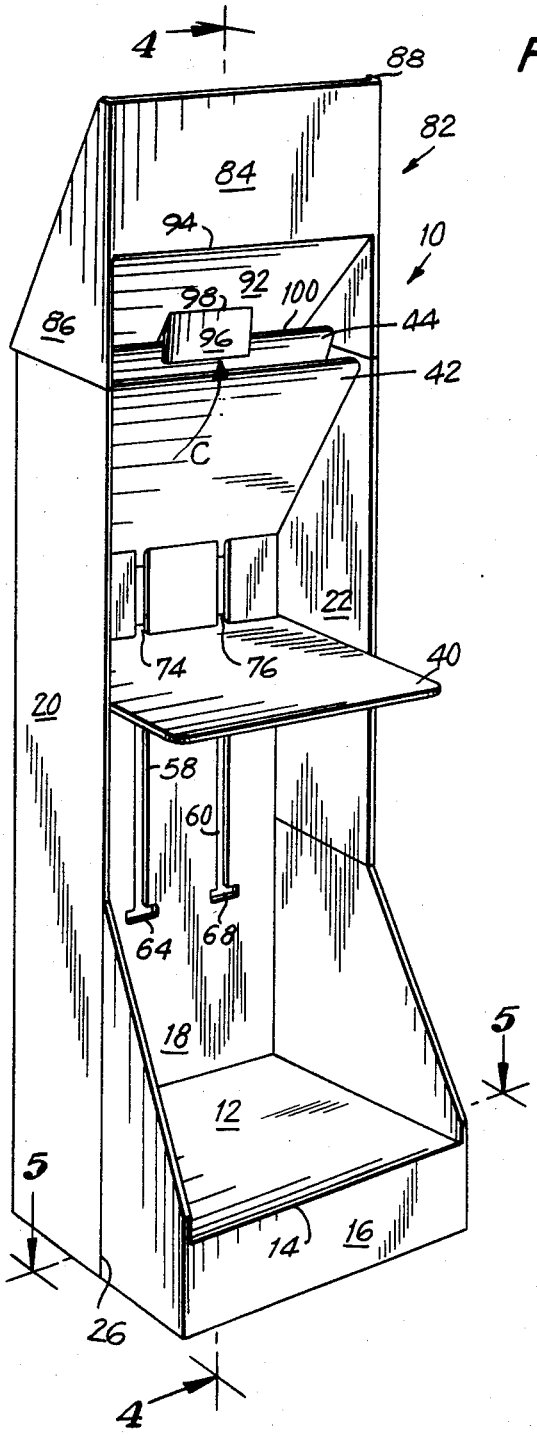
FIG. 3 is a front perspective view of the stand of FIG. 1 showing the movement of the empty shelves toward the storage position.
Figure 5:
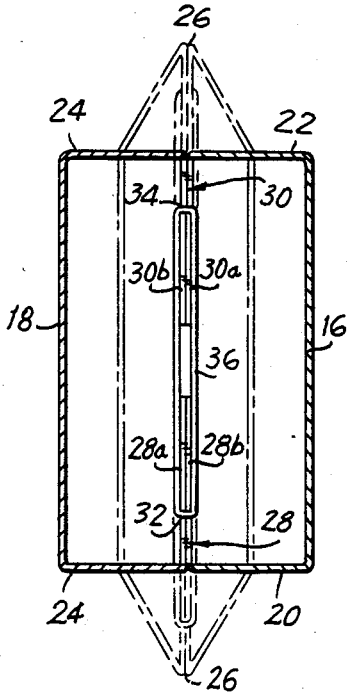
FIG. 5 is a sectional view taken on line 5—5 of FIG. 3.

A plurality of shelves, for example, the three illustrated shelves 40, 42, 44, are mounted on the stand 10 for longitudinal movement between an upper tilted storage position (for example, see shelf 44 in FIG. 3), and a generally horizontal display position (for example, see FIG. 1) in which each shelf is supported from below by the bottled beverages themselves and, in turn, each shelf supports additional bottled beverages loaded thereon.

As best shown in FIG. 1, a first group of bottled beverages 46 is stacked on the base panel 12, and the upper surfaces of these articles together form a platform or support surface on which the first shelf 40 may be reliably supported. With the first shelf 40 so supported, a second group of bottled beverages 48 is stacked on the first shelf 40, and the upper surfaces of these articles together form another platform or support surface on which the second shelf 42 is supported. With the second shelf 42 so supported, a third group of bottled beverages 50 is stacked on the second shelf 42, and the upper surfaces of these articles together form another platform or support surface on which the third shelf 44 is supported. Finally, with the third shelf 44 so supported, a fourth group of bottled beverages 52 is stacked on the third shelf 44. Of course, more or fewer than three shelves could be mounted on the stand and still be within the spirit of this invention.

In further accordance with this invention, height-adjustment means are provided for continuously adjustably moving each shelf to any desired elevation above the base panel 12. The height-adjustment means, in a preferred embodiment, comprises at least one, and preferably a pair, of longitudinally-extending guide chanels 54, 56 formed in, and extending at least partially along, the back panel 18. The guide channels 54, 56 have narrow transverse track sections 58, 60, respectively, of constant width. Each guide channel 54, 56 also has a pair of broader transverse entry sections 62, 64 and 66, 68, respectively, of greater width than that of the track sections 58, 60.

Figure 2:
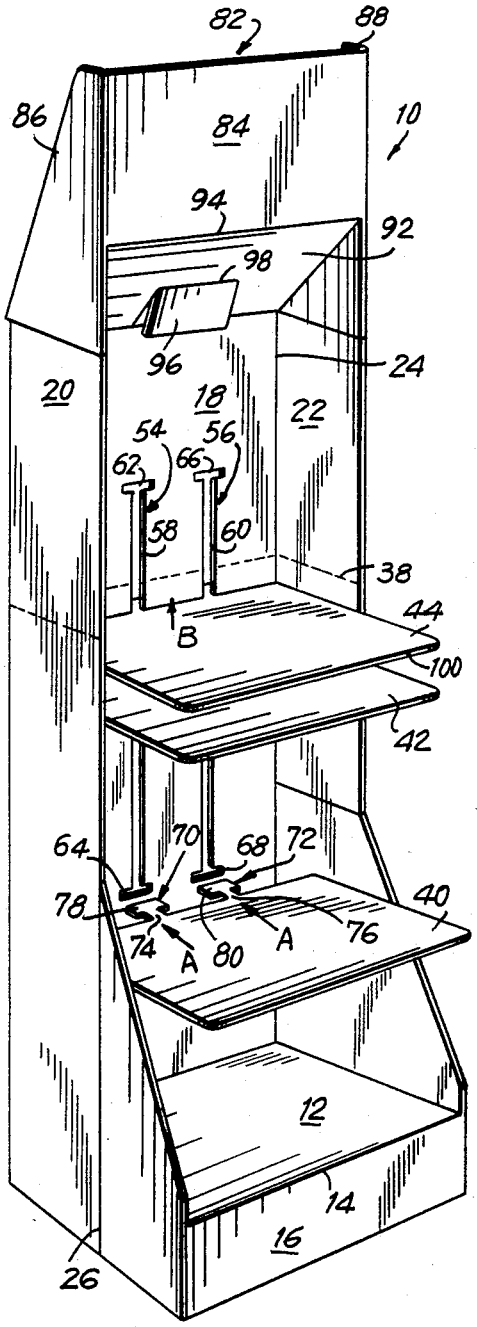
FIG. 2 is a front perspective view of the stand of FIG. 1 during assembly, but prior to loading with the beverage containers.

The height-adjustment means also comprises at least one, and preferably a pair, of transversely spaced-apart guide members or tabs 70, 72 mountable in the guide channels 54, 56, respectively, for movement along their respective track sections 58, 60 to the desired elevation. As shown in FIG. 2, representative tabs 70, 72 have head portions 78, 80 whose transverse width is equal to, or slightly smaller than, that of either entry sections 64, 68 or 62, 66 so as to be freely insertable in the direction of arrows A into either pair of entry sections. Tabs 70, 72 also have neck portions 74, 76 whose transverse width dimension is equal to, or preferably slightly smaller than, that of track sections 58, 60 so as to be freely slidable therealong in the direction of arrow B.

Each shelf can be mounted for movement along the track sections either before or after the erection of the stand to the erect condition. Each shelf can be positioned in an infinitely-adjustable continuous analogue manner to any desired height above the floor on which the stand is supported, and is not restricted, as in prior embodiments, to only a few predetermined discrete elevations. This greatly increases the versatility of the stand, and enables the stand to be used in connection with the displaying of diverse articles.

In use, shoppers will remove the bottled beverages from the topmost shelf 44 and, once shelf 44 is empty, the shelf 44 must be moved to the aforementioned storage position to enable shoppers to have access to the bottled beverages on the next lower shelf 42. For this purpose, a header 82 is mounted at an upper region of the upright support. The header 82 is a discrete structure which is preferably fabricated of a suitable material such as cardboard, and which, like the stand 10, is formed from a single sheet blank which is folded along folding and score lines into the illustrated desired shape. The header 82 has, in its fully-assembled condition, a front section 84, a pair of side sections 86, 88, a back section 90 and an inclined section 92. In the mounted position of the header, the side sections 86, 88 are coextensive with, and frictionally embrace, the side panels 20, 22; the back section 90 is coextensive with, and frictionally embraces, the back panel 18; and the inclined section 92 extends all the way from a front edge 94 at a rearward and downward constant slope to the back section 90. A flap 96 is die-cut and stamped out of the inclined section 92 at a central region thereof. The flap 96 is pivotable about a fold line 98.

Figure 4:
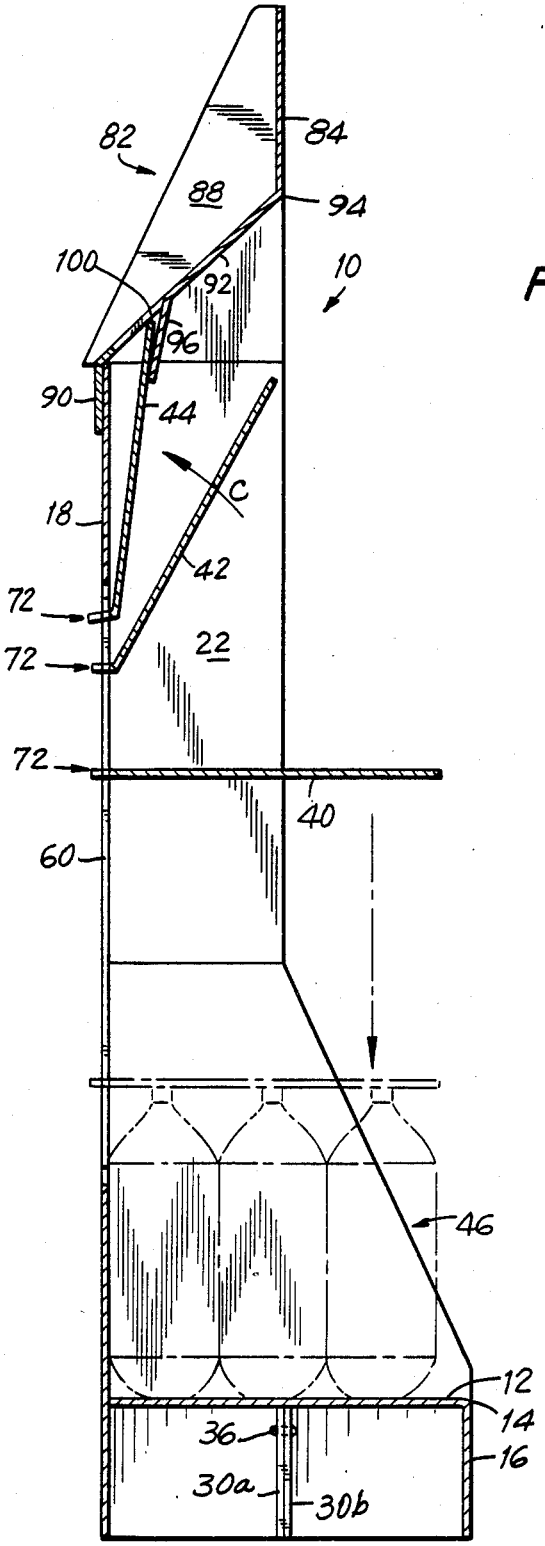
FIG. 4 is a sectional view taken on line 4—4 of FIG. 3.

As shown in FIG. 2, when the topmost shelf 44 is empty and desired to be moved to the storage position, the shelf 44 is initially moved upwardly in the direction of the arrow B and, thereupon, the shelf 44, while still mounted in the guide channels 58, 60, is tilted upwardly in the direction of curved arrow C toward the back panel 18. The flap 96, at this time, is pivoted forwardly about its fold line 98 a sufficient distance so that a front edge region 100 of the shelf 44 clears the lower edge of the flap 96. The front edge region 100 of the shelf 44 is eventually positioned behind the flap 96. Upon release of the flap 96, the flap will tend to return to its original position in the plane of the inclined section 92 and, during this return, the flap 96 will capture and clampingly hold the shelf 44 in the storage position in which, as best shown in FIG. 4, the shelf 44 is juxtaposed with the back panel 18 and is urged toward the same. As also shown in FIG. 4 the captured shelf 44 is bent relative to its tabs 70, 72. To facilitate such bending, transverse crease lines can be formed across the neck sections 74, 76 of the tabs 70, 72.

In the same manner, the shelf 42, when empty of bottled beverages, can be moved upwardly in the direction of arrow B and, thereupon, tilted in the direction of arrow C so as to be captured underneath the same flap 96. Finally, the lowermost shelf 40, when empty of bottled beverages, can be moved in the same manner described above and held in the storage position underneath the very same flap 96, so that all of the shelves can be simultaneously held by the single flap 96 in the same storage position.

It is further advantageous if the stand is pre-assembled with the shelves in the storage position so that when the stand is erected to the erect condition, each shelf, in its turn, can be freed from underneath the flap 96 and pulled down to the desired elevation.

It will be understood that each of the elements described above, or two or more together, also may find a useful application in other types of constructions differing from the types described above.

For example, the shelves need not be held by a single flap 96, but could equally well be held by more than one flap and, indeed, such flaps need not be located on a discrete header, but could be formed on the back panel 18 and/or the side panels 20, 22. The guide channels and corresponding tabs need not be limited to the pair illustrated, but, instead, can be more or fewer than two in number. The guide channels could likewise be formed in the side panels, rather than the back panel, in which case, the guide members are advantageously formed as guide pins or dowels extending transversely outwardly of, and provided on, each shelf, the dowels being slidable along the guide channels to any elevation. Also, the track sections need not be a single continuous course, but, instead, can be comprised of a set of interrupted colinear courses. It should also be noted that, rather than providing flaps as a holding means, virtually any other holder, e.g. a clip, can be used.

While the invention has been illustrated and described as embodied in a beverage display stand, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention and, therefore, such adaptations should and are intended to be comprehended within the meaning and range of equivalence of the following claims.

What is claimed as new and desired to be protected by Letters Patent is set forth in the appended claims:

1. A stand for displaying articles, comprising:

(a) a base on which articles are supportably stacked;

(b) an upright support extending upwardly from the base in a longitudinal direction;

(c) a shelf mounted on the support for longitudinal movement between a storage position in which the shelf is tilted at an angle to a horizontal plane, and a display position in which the shelf lies in the horizontal plane and is supported from below by the articles stacked on the base and, in turn, supports additional articles stacked on the shelf;

(d) height-adjustment means for continuously adjustably moving the shelf to any desired elevation above the base, including a longitudinally-extending guide channel formed in, and longitudinally extending at least partly along, the upright support, and a guide member on the shelf and mounted in the guide channel for movement therealong to the desired elevation; and (e) holding means for holding the shelf in the storage position when the shelf is not in the display position, said holding means being located at an upper region of the upright support, and being operative for capturing the tilted shelf between the holding means and the upright support.

2. The stand as recited in claim 1, wherein the shelf and the guide member are generally planar, and wherein the guide member extends rearwardly of the shelf into and past the guide channel.

3. The stand as recited in claim 1, wherein the height-adjustment means includes an additional guide channel spaced transversely of the first-mentioned guide channel on the upright support, and an additional guide member spaced transversely of the first-mentioned guide member on the shelf.

4. The stand as recited in claim 1, wherein the guide channel has a narrow and a broader transverse section, and wherein the guide member has a neck and a head portion receivable in the narrow and the broader transverse section, respectively.

5. The stand as recited in claim 1, and further comprising at least one additional shelf mounted on the support for longitudinal movement between an additional storage position and an additional display position in which the additional shelf is supported from below by the articles stacked on the first-mentioned shelf and, in turn, supports further articles stacked on the additional shelf; and wherein the height-adjustment means includes at least one additional guide member on the additional shelf and mounted in the same guide channel for movement therealong to any desired elevation above the first-mentioned shelf; and wherein the holding means is further operative for holding the additional shelf in the additional storage position when the additional shelf is not in the additional display position.

6. The stand as recited in claim 1, and further comprising a header mounted on the upper region of the upright support, said header including a resiliently-biased flap which constitutes the holding means.

7. The stand as recited in claim 1, wherein the upright support is a back panel having longitudinal edges; and further comprising side panels hingedly connected at the longitudinal edges to the back panel; and wherein the base includes a generally upright front panel having a front transverse edge, and a base panel hingedly connected at the front transverse edge to the front panel.

8. The stand as recited in claim 7, and further comprising a fold line extending transversely across the upright panel and about which the stand is foldable and erectable from a collapsed condition to an erect condition.

9. A stand for displaying articles, comprising:

(a) a base on which articles are supportably stacked and including a generally upright front panel having a front transverse edge, and a base panel hingedly connected at the front transverse edge to the front panel;

(b) an upright support extending upwardly from the base in a longitudinal direction and constituting a back panel having longitudinal edges, said support further including side panels hingedly connected at the longitudinal edges to the back panel, said support also having a fold line extending transversely across the upright panel and about which the stand is foldable and erectable from a collapsed condition to an erect condition;

(c) a shelf mounted on the support for longitudinal movement between a storage position and a display position in which the shelf is supported from below by the articles stacked on the base and, in turn, supports additional articles stacked on the shelf;

(d) height-adjustment means for continuously adjustably moving the shelf to any desired elevation above the base, including a longitudinally-extending guide channel formed in, and longitudinally extending at least partly along, the upright support, and a guide member on the shelf and mounted in the guide channel for movement therealong to the desired elevation; and (e) holding means for holding the shelf in the storage position when the shelf is not in the display position.

10. The stand as recited in claim 9, wherein the shelf lies in a horizontal plane in the display position, and is tilted at an angle to the horizontal plane in the display position.

11. The stand as recited in claim 10, wherein the holding means is located at an upper region of the upright support, and is operative for capturing the tilted shelf between the holding means and the upright support.

12. The stand as recited in claim 9, and further comprising support panels, each hingedly connected to one of the side panels and extending toward each other into the space between the front and back panels underneath the base panel as considered in the erect condition, and means for urging the support panels toward one another to erect the stand with a snap-type action.

13. The stand as recited in claim 12, wherein each support panel has an elongated slot extending substantially normal to the base panel in the erect condition and opening onto an edge of the respective support panel, said base panel resting on an upper edge region of each of the support panels in the erect condition; and wherein the urging means includes an endless elastically-yieldable element mounted in each slot and extending along the support panels between the slots.

* * * * *